United States Patent [19]

Lauterbach

[11] Patent Number: 4,893,638

[45] Date of Patent: Jan. 16, 1990

[54] CIGARETTE

[75] Inventor: John H. Lauterbach, Louisville, Ky.

[73] Assignee: Brown & Williamson Tobacco Corporation, Louisville, Ky.

[21] Appl. No.: 281,599

[22] Filed: Dec. 9, 1988

[51] Int. Cl.[4] ..... A24D 1/00; A24B 1/00

[52] U.S. Cl. ..... 131/364; 131/360; 131/347; 131/290

[58] Field of Search ..... 131/359, 369, 364, 347, 131/360, 290

[56] References Cited

U.S. PATENT DOCUMENTS

| | | | |
|---|---|---|---|
| Re. 32,615 | 3/1988 | Luke | 131/360 |
| 3,042,552 | 7/1962 | Rosenberg et al. | 131/355 |
| 4,838,286 | 6/1989 | Phelpstead | 131/360 |

*Primary Examiner*—V. Millin
*Assistant Examiner*—Jennifer L. Doyle
*Attorney, Agent, or Firm*—Charles G. Lamb

[57] ABSTRACT

A cigarette having a generally cylindrical tobacco rod having a tobacco filler of ground tobacco. The tobacco rod has a circumference within the range of 10 mm to 19 mm. The tobacco rod is circumscribed by a combustible paper.

4 Claims, 1 Drawing Sheet

CIGARETTE

BACKGROUND OF THE INVENTION

The invention relates to cigarettes, and, more particularly to a cigarette having a tobacco filler of ground tobacco as opposed to cut or reconstituted tobacco.

Cigarettes are typically made with a cut tobacco filler or reconstituted tobacco. One of the reasons for the use of cut tobacco and reconstituted tobacco as the filler is to provide structural integrity to the tobacco filler at the open ends of the tobacco column so the tobacco will not spill out.

SUMMARY OF THE INVENTION

The present invention provides a cigarette having a tobacco column of a ground tobacco filler which provides structural integrity to the filler at the open ends of the tobacco column.

More particularly, the present invention provides a cigarette comprising a generally cylindrical cigarette rod which comprises a tobacco filler of ground tobacco, the circumference of the tobacco rod being within the range of 10 mm to 19 mm, and a circumscribing wrapper of combustible paper.

BRIEF DESCRIPTION OF THE DRAWINGS

A better understanding of the invention will be had upon reference to the following description in conjunction with the accompanying drawings wherein.

DETAILED DESCRIPTION OF THE PREFERRED EMBODIMENT

Figure 1:
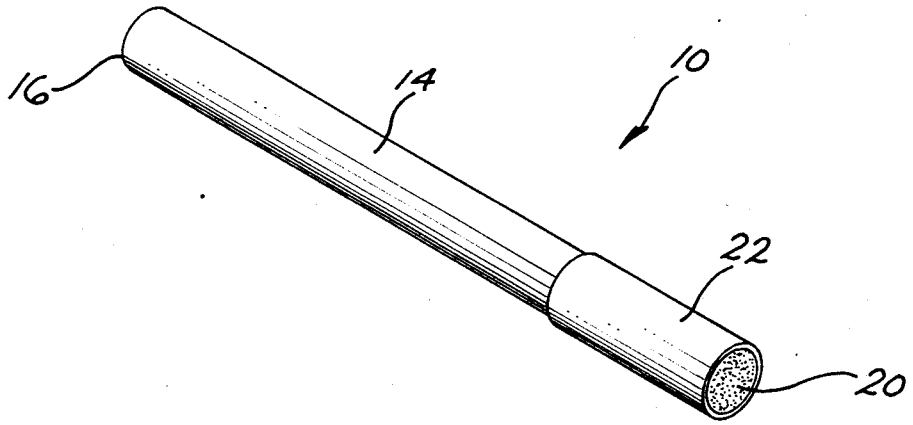
FIG. 1 is a perspective view of a cigarette of the invention.
Figure 2:
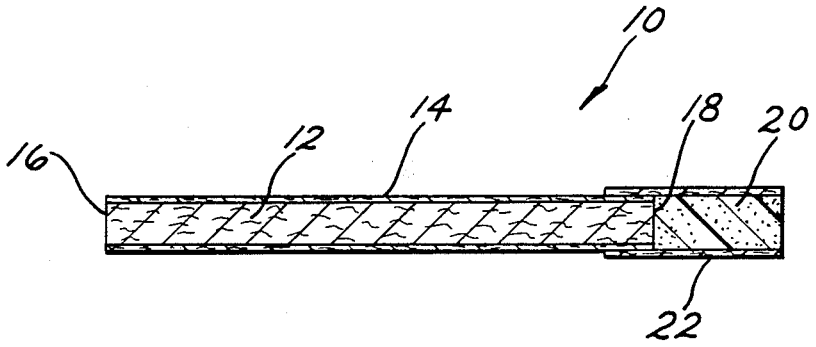
FIG. 2 is a longitudinal cross-sectional view of the cigarette of FIG. 1.

With reference to FIGS. 1 and 2, there is shown a filtered cigarette, generally denoted as the numeral 10, which includes a tobacco column 12 circumscribed by a combustible wrapper 14 leaving both ends 16 and 18 of the tobacco column 12 open or exposed. A filter 20 is coaxially located at one end 18 of the tobacco column 12. The filter 20 is attached to the wrapped tobacco column 12 with a tipping material 22 which circumscribes the filter 20 and overlaps a portion of the tobacco column 12.

The tobacco column 12 has a circumference in the range of from approximately 10 mm to 19 mm and length about b 100 mm. And, the tobacco column 12 consists of ground tobacco having a particle size in the range of approximately 0.5 mm to 3.00 mm. In addition, the tobacco particle filling or packing density is in the range of approximately 350 mg/cm$^3$ to 450 mg/cm$^3$. The free burn rate of the tobacco column 12 is within a range of approximately 50.0 mg/min. to 70.0 mg/min.

While the small circumference provides very reasonable stability or integrity to the particles of tobacco at the exposed tobacco end 16 of the tobacco column 12, it is preferrable that the tobacco particles at the exposed end 16 be coated with a polymeric material such as, for example, polyvinyl acetate and copolymers of acrylic acid esters and the like. This coating can be accomplished by, for example, spraying a solution or emulsion of the polymeric material on the exposed end 16 of the tobacco column 12 any time during the manufacturing process after the tobacco column has been wrapped by the combustible wrapper.

The present invention provides for the use of tobacco particles or fines without having to first process the particles or fines into reconstituted tobacco.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. A cigarette comprising:

a tobacco column consisting of ground tobacco with a particle size in the range of about 0.5 mm to about 3.0 mm, said tobacco column having a circumference of from about 10 mm to about 19 mm and a packing density in the range of approximately 350 g/cm$^3$ to 450 mg/cm$^3$; and, a circumscribing wrapper of combustible paper circumscribing said tobacco column.

2. The cigarette of claim 1, wherein the particles of tobacco exposed to at least one end of the wrapped tobacco column are coated with a polymeric material.

3. The cigarette of claim 2, further comprising a smoke filter attached to the tobacco column at the end of the tobacco column not coated with the polymeric material.

4. The cigarette of claim 1, wherein the burn rate of the tobacco column is in the range of approximately 50.0 mg/min. to 70.0 mg/min.

* * * * *

UNITED STATES PATENT AND TRADEMARK OFFICE

CERTIFICATE OF CORRECTION

PATENT NO. : 4,893,638

DATED : January 16, 1990

INVENTOR(S) : John H. Lauterbach

It is certified that error appears in the above-identified patent and that said Letters Patent is hereby corrected as shown below:

Column 2, line 37, $g/cm^3$ is changed to $mg/cm^3$.

Signed and Sealed this

Second Day of June, 1992

*Attest:*

*Attesting Officer*

DOUGLAS B. COMER

*Acting Commissioner of Patents and Trademarks*